US005092234A

United States Patent [19]

Von Rohr

[11] Patent Number: 5,092,234

[45] Date of Patent: Mar. 3, 1992

[54] ROTATING DRUM CONTAINER CRUSHER

[76] Inventor: James R. Von Rohr, 1815 SW. Fairlaw Rd., Topeka, Kans. 66604

[21] Appl. No.: 648,845

[22] Filed: Jan. 31, 1991

[51] Int. Cl.[5] ..... B30B 15/14; B30B 9/32; B30B 3/02

[52] U.S. Cl. ..... 100/53; 100/156; 100/168; 100/172; 100/173; 100/902; 241/99

[58] Field of Search ..... 100/53, 168, 172, 173, 100/156, 902, 210; 241/189 R, 99

[56] References Cited

U.S. PATENT DOCUMENTS

| | | | |
|---|---|---|---|
| 1,328,090 | 1/1920 | McNeil | 100/156 X |
| 2,675,970 | 4/1954 | Edwards | 100/156 X |
| 3,504,621 | 4/1970 | Qualheim | 100/172 X |
| 3,608,477 | 9/1971 | Weber et al. | 100/156 |
| 3,889,886 | 6/1975 | Spivey | 241/99 X |
| 3,951,059 | 4/1976 | Morris | 100/173 |
| 4,098,181 | 7/1978 | Schultz | 100/902 X |
| 4,195,562 | 4/1980 | Mickler | 100/902 X |
| 4,213,386 | 7/1980 | Telling | 100/902 X |
| 4,240,341 | 12/1980 | Whipple et al. | 100/902 X |
| 4,265,170 | 5/1981 | Schulze, Jr. | 100/902 X |
| 4,316,410 | 2/1982 | Davis, Jr. | 100/902 X |
| 4,369,699 | 1/1983 | Dailey | 100/156 |
| 4,463,670 | 8/1984 | Thomas | 100/902 X |
| 4,516,489 | 5/1985 | Ballo | 100/156 X |
| 4,606,265 | 8/1986 | Meier | 100/902 X |
| 4,667,593 | 5/1987 | Kennedy | 100/902 X |
| 4,722,269 | 2/1988 | Watkinson | 100/156 |

FOREIGN PATENT DOCUMENTS

| | | | |
|---|---|---|---|
| 2005720 | 8/1971 | Fed. Rep. of Germany | 241/99 |

*Primary Examiner*—Harvey C. Hornsby
*Assistant Examiner*—Stephen F. Gerrity
*Attorney, Agent, or Firm*—Litman, McMahon & Brown

[57] ABSTRACT

A container crusher for crushing aluminum beverage cans, two-liter plastic beverage bottles, and the like uses a motor-driven rotatable drum in a housing. Mounted on the periphery of the drum are a plurality of angled crusher arms which contact containers introduced into the housing and crush them between the rotating crusher arms and the walls of the housing. Mounted on top of the housing is a circular tray into which containers to be crushed are placed. The tray has a feed opening into the crusher housing which is covered by a safety cover which, in turn, has an inlet opening displaced from the feed opening. Containers are introduced into the feed opening of the safety cover which is sized and positioned so as to prevent an operator's hand from entering the crusher housing. The crusher unit can be directly attached to a conventional 40-gallon trash can, or, alternatively, can be placed inside a conventional 55-gallon drum.

16 Claims, 2 Drawing Sheets

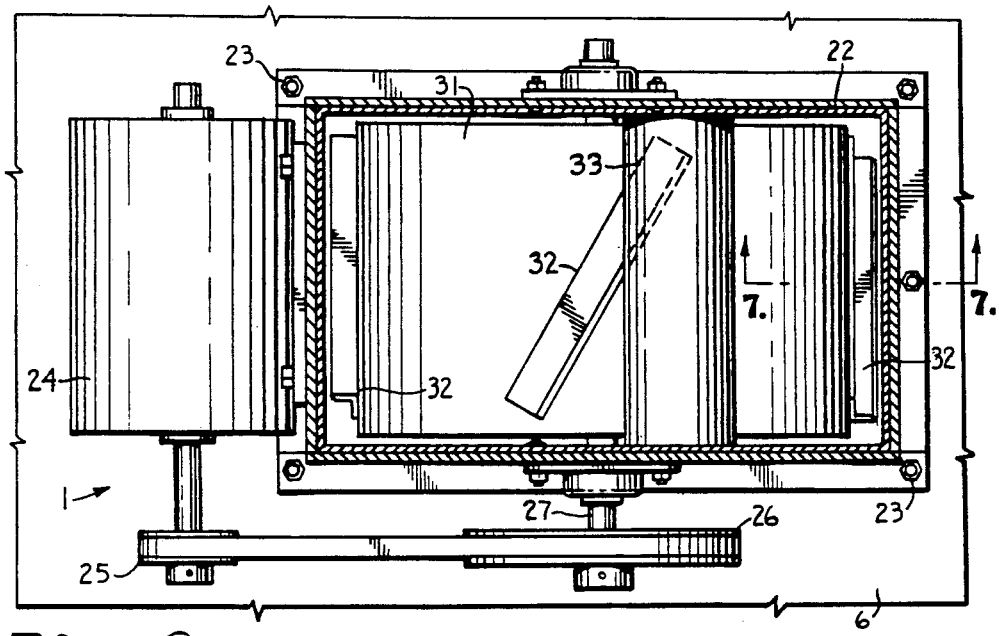
Fig.6.
Fig.8.
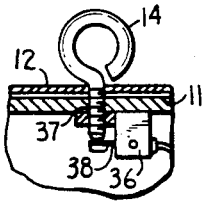
Fig.7.
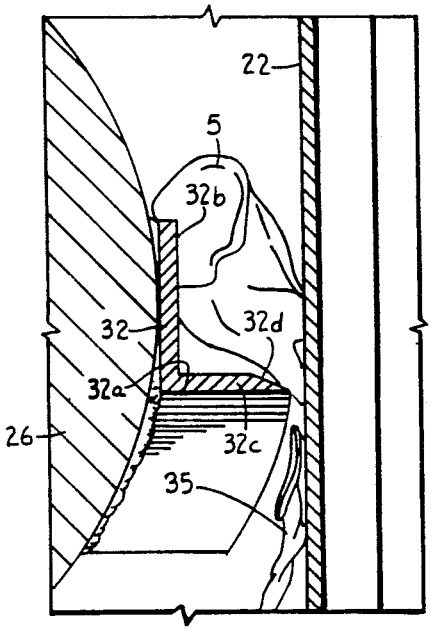
Fig.9.
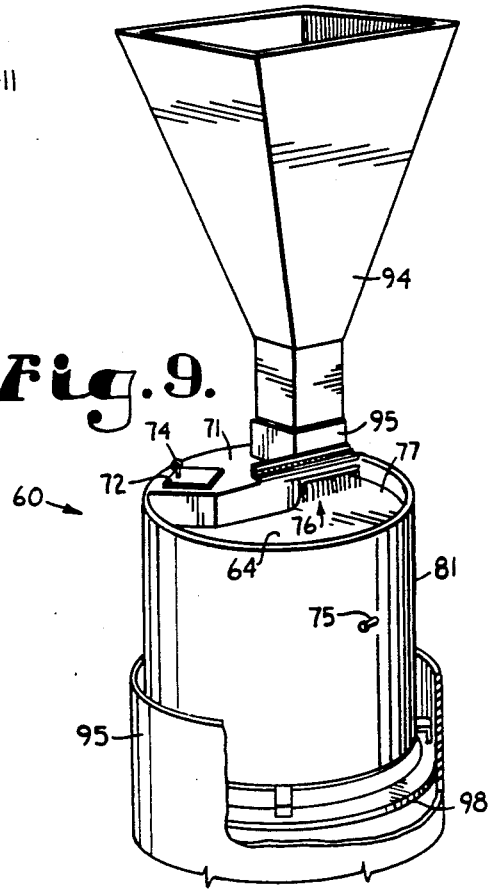

ROTATING DRUM CONTAINER CRUSHER

BACKGROUND OF THE INVENTION

The invention of the present application relates to a compact crusher apparatus for crushing containers, especially beverage containers such as aluminum cans and two-liter plastic bottles.

With the increased interest in environmental concerns, the steadily decreasing capacity of sanitary landfills, and the dwindling of natural resources, it is increasingly important to recycle or, at minimum, to greatly compress the volume of generated trash. Many communities have adopted mandatory recycling programs and voluntary recycling of reusable materials is at an all time high. The huge volume of beverage containers generated from these recycling operations must be compressed to enable their economical transport to recycling centers and factories. Heretofore, beverage containers have generally been transported to regional recycling centers in an uncompacted condition where they are crushed in large, industrial-sized compactors. This entails many more trips to these recycling centers than would be necessary if the containers could be crushed prior to their transport.

Ordinary kitchen-type trash compactors have been used for domestic crushing of recyclable beverage containers, however, they generally employ a linear-type crushing action which is unsuitable for complete compaction of cans and plastic bottles. Other compactors have been either hand-operated, and thus too small and slow for the efficient compaction of relatively large numbers of containers, or, conversely, large and unwieldy mechanized crushers which are not practical for small scale domestic or institutional use.

It is clear then, that a need exists for a compact, reliable, and economical beverage container crusher for domestic or institutional use. It is also clear that such a crusher should be simple and safe to operate.

SUMMARY OF THE INVENTION

The present invention is a container crusher for crushing aluminum beverage cans, plastic bottles and the like to a greatly reduced volume to enable their economical transport to regional recycling centers or landfills. The apparatus includes a cylindrical outer housing and a rectangular inner housing with an opening at the top into which the containers are introduced. Near the bottom of the inner housing is mounted a rotatable cylindrical drum with its rotation axis being perpendicular to the longitudinal axis of the cylindrical outer housing.

The cylindrical drum is rotated via an axle which extends through the side walls of the cylindrical housing, and onto which is mounted a pulley which is driven by a belt drive attached to an electric motor mounted on the outside of the inner housing, but inside the outer housing. Attached to the periphery of the rotating drum are a plurality of crusher arms which contact beverage containers introduced into the inner housing and crush them against a side wall of the inner housing. The crusher arms are mounted on the rotating drum at an angle with respect to the longitudinal axis of the drum. The angled crusher arms terminate in a beveled end which efficiently crushes aluminum cans and two-liter plastic beverage containers against the walls of the inner housing.

A tray is attached to the top of the outer housing with a vertical opening in the tray sized and positioned to permit containers to be introduced into the inner housing. This opening is covered by a safety cover with a horizontal opening which is displaced from the vertical opening in the tray. The horizontal opening in the safety cover is sized to permit the introduction of beverage cans and two-liter bottles into the safety cover, but is displaced far enough away from the vertical opening in the tray to prevent operators from putting their hands into the crusher mechanism.

An alternative embodiment allows a hopper to be placed on top of the tray to facilitate the introduction of large numbers of cans and bottles.

The bottom of the outer cylindrical housing is covered by a circular bottom plate which has an opening positioned under the inner housing to permit the crushed containers to exit the crusher. The outer housing is sized to permit its attachment to an ordinary 40-gallon trash can. Alternatively, the crusher housing can be placed inside a standard 55-gallon drum to rest on a ledge provided inside the drum.

OBJECTS AND ADVANTAGES OF THE INVENTION

The principal objects of the present invention are: to provide an improved container crusher apparatus for domestic or institutional use; to provide such a crusher apparatus which efficiently crushes containers such as aluminum cans and plastic bottles to a small volume; to provide such a crusher apparatus which is designed to prevent an operator from introducing a hand into the working parts of the apparatus; to provide such a crusher apparatus which is compact and easily transportable yet extremely sturdy and durable; to provide such a crusher apparatus which uses novel angled and bevel-ended crusher arms which efficiently crush the containers; to provide such a crusher apparatus which can be attached to a standard 40-gallon trash can or to a 55-gallon drum for holding the crushed containers; to provide such a crusher apparatus which can be used with an attached hopper to permit relatively large numbers of containers to be rapidly compacted; to provide such a crusher apparatus which uses an ordinary electric motor as a drive means; to provide such a crusher apparatus which is economical to manufacture and easy to use; and to provide such a crusher apparatus which is particularly well suited for its intended purpose.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 6 is an enlarged and fragmentary cross-sectional view of the container crusher, taken along line 6—6 of FIG. 5.

FIG. 7 is an enlarged and fragmentary cross-sectional view of a portion of the container crusher, taken along line 7—7 of FIG. 6.

FIG. 8 is an enlarged and fragmentary cross-sectional view of a screw eye and safety switch used to secure an access panel into the crusher apparatus.

FIG. 9 is a perspective view of a modified container crusher in accordance with the present invention, shown with a hopper attached to and mounted inside a 55-gallon barrel.

DETAILED DESCRIPTION OF THE INVENTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
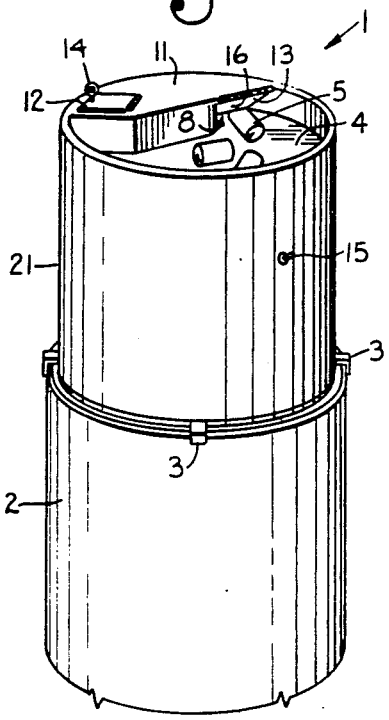
FIG. 1 is a perspective view of a container crusher in accordance with the present invention with the crusher shown overlying and attached to a conventional 40-gallon trash can.

Referring to FIG. 1, a first embodiment of a container crusher apparatus in accordance with the present invention is generally designated by the reference numeral 1. The crusher apparatus 1 is shown attached to a conventional 40-gallon trash can 2 via a plurality of angled and radially outward extending attachment arms 3. A plurality of aluminum beverage cans or containers 5 are shown in a cover tray 4. A safety cover 11 covers substantially most of an opening 8 into the interior of the crusher 1. Incorporated into the safety cover 11 is a hinged access door 12, which is securely held in place by a threaded screw eye 14.

The safety cover 11 has first or feed opening 13 through which the containers 5 are introduced into the crusher apparatus 1. A switch 15, mounted on the side of the crusher apparatus 1, controls power to the crusher apparatus 1 and also controls power to a solenoid actuated safety door 16 which covers the opening 13 when power to the crusher is turned off and is withdrawn from the opening 13 when crusher power is turned on.

Figure 2:
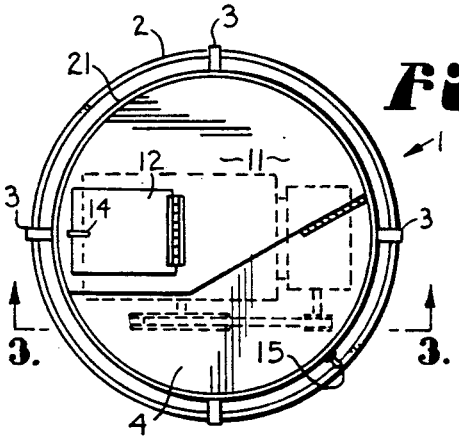
FIG. 2 is an enlarged top plan view of the container crusher.

FIG. 2 is a top plan view of the container crusher apparatus illustrating the relative sizes and positions of the safety cover 11 and the cover tray 4.

Figure 3:
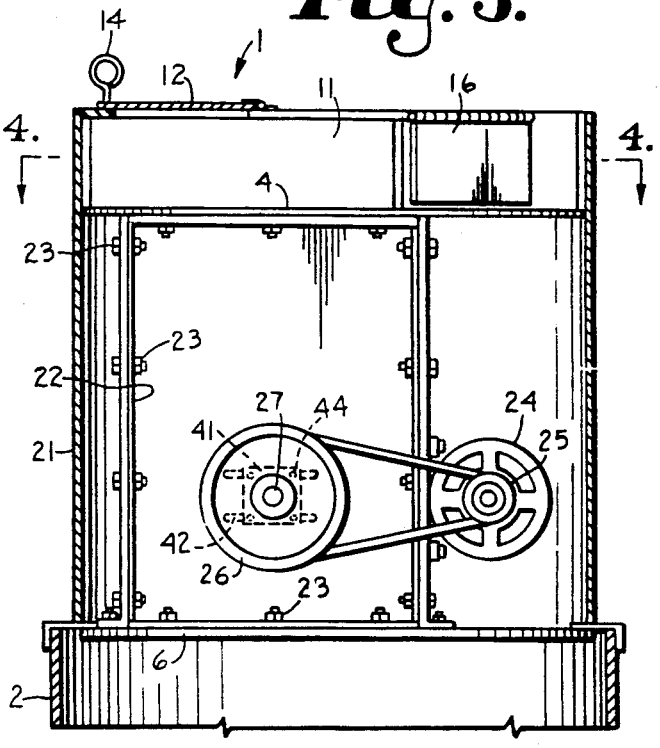
FIG. 3 is an enlarged and fragmentary cross-sectional view of the container crusher and trash can, taken along line 3—3 of FIG. 2.

FIG. 3 is an enlarged cross-sectional view of the container apparatus, taken along lines 3—3 of FIG. 2. The container crusher 1 comprises a cylindrical outer housing 21 and a rectangular inner housing 22. The outer housing 21 is constructed of relatively thin steel or aluminum. The inner rectangular housing 22, on the other hand, is constructed of four thick steel plates which overlap each other and are attached to each other via a plurality of reinforcing bolts and nuts 23. The steel plates of the housing 22 are also bolted to the cove tray 4 and to a bottom circular plate 6 via other bolts and nuts 23.

An electric motor 24 is bolted onto one side of the inner rectangular housing 22. The motor 25 drives the container crusher 1 via a pulley and belt system. In particular, a motor pulley 25 and a drum pulley 26 are sized so as to reduce the speed of the motor 24 from 1200 rpm to a range of about 500–700 rpm for the drum 31 (FIG. 5) rotating within the container crusher 1. It has been found that speeds slower than this range result in jamming of the containers and speeds faster than this range result in tearing and shredding of the containers.

Also shown in FIG. 3 is an adjustable drum mounting bracket 41 and an adjustment slot 42 in the inner housing 22. The bracket 41 is adjustable within the slot 42 to enable the drum 31 (see FIG. 5) to be adjusted toward or away from the sides of the inner container 22 to accommodate container 5 of various sizes. Once the bracket 41 is suitably positioned, a plurality of bolts 44 around the periphery of the bracket 41 are tightened to secure the bracket 41 in place.

Figure 4:
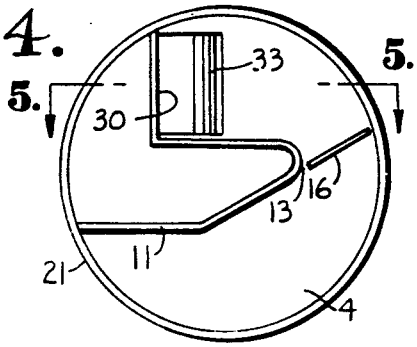
FIG. 4 is a cross-sectional view of the container crusher, taken along line 4—4 of FIG. 3.

FIG. 4 is a cross-sectional view of the container crusher, taken along lines 4—4 of FIG. 3. FIG. 4 illustrates the contours of the safety cover 11, and the relative position of the safety cover opening 13 that is entered by horizontal movement of the containers 5 and the safety door 16. FIG. 4 also illustrates a second or feed opening 30 which is entered by vertical movement of the container 5 and which opens into the interior of the inner rectangular housing 22.

Figure 5:
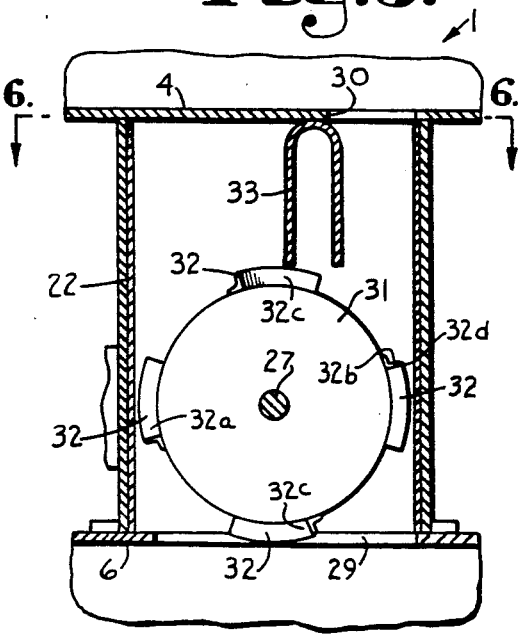
FIG. 5 is an enlarged and fragmentary cross-sectional view of the container crusher, taken along line 5—5 of FIG. 4.

FIG. 5 is a cross-sectional view of the container crusher 1, taken along line 5—5 of FIG. 4. The inner rectangular housing 22 contains a rotating drum 31. The drum 31 is attached to an axle 27 which is driven by the drum pulley 26, as shown in FIG. 3. Attached to the rotating drum 31 are a plurality of angled crusher arms 32. Each of the crusher arms 32 comprises an angle iron section 32*a*having a first side 32*b* attached to and abutting the drum 31 and a second side 32*c* with a tapered edge 32*d* extending radially outwardly from the drum 31, as shown in FIGS. 5 and 7. Each of the arms 32 is positioned so that the second side 32*c* leads the first side 32*b* during rotation of the drum 31 with the of the tapered edge 32*d* being on the trailing side of the second side 32*c*. An inverted U-shaped guard 33 is attached to the upper cover plate 4 proximate the feed opening 30. The U-shaped guard 33 prevents containers 5 introduced into the rectangular inner housing 22 via the feed opening 30 from bouncing over into the upcoming side of the rotating drum 31 which could allow the containers 5 to accumulate and could jam the apparatus 1 by being crushed between upcoming ones of the angled crusher arms 32 and an opposite side wall of the rectangular inner housing 22. An exit opening 29 is provided in the bottom plate 6 for permitting the crushed containers 5 to exit the crusher apparatus 1.

FIG. 6 is a cross-sectional view of the crusher apparatus 1, taken along line 6—6 of FIG. 5, showing the angle of the crusher arms 32. The crusher arms 32 are attached at an angle of approximately 30 degrees from the longitudinal axis of the axle 27. It has been found that this angle provides a more prolonged period of time through which the crusher arms 32 compress a container 5 against the side walls of the inner rectangular housing 22. This results in a more efficient crushing of the containers 5.

FIG. 7 is a cross-sectional view of a portion of the container crusher 1, taken along line 7—7 of FIG. 6. FIG. 7 illustrates a container 5 being crushed between the angled crusher arm 32 and the side wall of the inner rectangular housing 22. A plurality of other crushed containers 35 are also shown.

FIG. 8 illustrates a safety feature incorporated into the hinged access panel 12. The screw eye 14 is permanently attached to the hinged access panel 12. A safety switch 36 has a spring loaded arm 38. As the screw eye 14 is turned into a threaded bore 37 within the safety cover 11, the bottom of the screw eye contacts the operating arm 38, urging it downward and thus closing the switch 36. The safety switch is wired in series with the control switch 15 (FIG. 1) on the outside of the outer housing 21. As the screw eye 14 is removed from the threaded bore 37, the safety switch 36 is opened, thus disabling the crusher apparatus 1, when the access panel 12 is opened.

FIG. 9 is a perspective view of a second embodiment of a container crusher in accordance with the present invention generally designated by the reference numeral 60. A hopper 94 is shown inserted into a flanged rectangular, receiver 95 having an interior opening into a safety cover 71. The hopper 94 can be used for introducing relatively large numbers of aluminum cans or plastic beverage containers into the container crusher 60. Note that the flanged hopper receiver 95 is offset with respect to a feed opening 76 into the container crusher 60. This causes containers introduced through the hopper 94 to be indirectly fed into a feed opening in a top tray 64 which prevents jamming of the container crusher 60 by the too rapid introduction of a multitude of containers. FIG. 9 also illustrates a plurality of stiff bristles 77 which provide a mechanical resistance to containers introduced into the safety cover 71. This is in place of the solenoid actuated safety door 16 of the embodiment FIG. 1, but can also be used with such a door. The crusher 60 in FIG. 9 is shown positioned within a standard 55-gallon drum 97 which has been modified to include an interior ledge 98 on which the crusher 60 sits.

One embodiment of the container crusher in accordance with the invention was constructed of the following materials and using the following specifications, which are recited merely as an example and such example is not intended to be limiting upon the scope of the claims:

The total crusher dimensions were 22" in diameter and 22" deep. The cover tray was 4" deep. The drum was constructed of a 10" section of 10½" steel pipe with walls ⅜" thick. The drum had end plates which were constructed of ¼" thick steel plates and the axle was a ¾" shaft welded to the drum and balanced. The crusher arms were constructed of ⅛" thick steel angle irons with one leg ½" long and the tapered crushing leg was ⅜" long. The inlet opening measured 6 and ¾".

When larger containers such as two-liter plastic bottles are crushed, as compared to cans, the inlet and outlet openings must be varied in size to accommodate the large bottles.

While the container crusher has been described as useful for crushing aluminum cans and plastic bottles, it should be apparent that it could be increased in size and strength to accommodate larger and stronger materials.

It is to be understood that while certain forms of the present invention have been illustrated and described herein, it is not to be limited to the specific forms or arrangement of parts described and shown.

What is claimed and desired to be secured by Letters Patent is as follows:

1. A container crusher apparatus for crushing container such as aluminum beverage cans, plastic bottles and the like, said crusher apparatus comprising:

(a) a longitudinally-extending cylindrical outer housing with a circular bottom plate enclosure and a circular top tray enclosure;

(b) a rectangular inner housing within said outer housing, said inner housing having at least one side wall and being attached to said bottom plate and said top tray;

(c) said top tray including a feed opening sized and positioned to permit the containers to be introduced into said inner housing, said bottom plate including an outlet opening sized and positioned to permit crushed containers to exit said inner housing; and (d) a rotatable cylindrical drum positioned within said inner housing, the rotation axis of said drum being perpendicular to the longitudinal axis of said outer housing; said drum having a periphery and having at least one crusher arm attached to said periphery; said drum having adjustment means for fixedly adjusting said drum and being positioned for selectively alternatively crushing the aluminum can and plastic bottle containers introduced into said inner housing by crushing the containers against said side wall of said inner housing when said drum is rotated.

2. The container crusher apparatus in accordance with claim 1, wherein:

(a) said crusher arm comprises an angle iron section with a first side of said angle iron attached to and abutting said periphery of said drum and a second side of said angle iron extending radially outward from said periphery of said drum.

3. The container crusher apparatus in accordance with claim 2, including:

(a) a tapered leading edge provided along said second side of said angle iron.

4. The container crusher apparatus in accordance with claim 3, wherein:

(a) said angle iron is positioned so that said second side leads said first side during rotation of said drum, the taper of said tapered edge being on the trailing side of said second side.

5. The container crusher apparatus in accordance with claim 1, including:

(a) a safety cover placed over said feed opening in said top tray, said safety cover including the inlet opening adapted to receive containers fed in a horizontal direction through which containers are introduced into said safety cover, said inlet opening being positioned a sufficient distance from said feed opening to prevent an operator from reaching a hand into said feed opening.

6. The container crusher apparatus in accordance with claim 5, wherein:

(a) said safety cover includes an access opening displaced from said feed opening in said top tray and adapted to receive a hopper for the efficient introduction of relatively large numbers of the containers into said crusher apparatus.

7. The container crusher apparatus in accordance with claim 1, including:

(a) said drum having a cylinder and an axle extending through the center of said cylinder; said axle having an axle pulley;

(b) cooperating apertures in said rectangular inner housing for receiving said axle therethrough;

(c) an electric motor mounted outside of said inner housing, but within said outer housing; said motor having a motor pulley; and (d) a belt drive connecting said motor pulley and said axle pulley such that said drum is driven thereby.

8. The container crusher apparatus in accordance with claim 7, including:

(a) said apertures being shaped as elongated slots such that said drum is adjustable toward and away from said side wall of said inner housing to selectively adjust for crushing of the aluminum can and plastic bottle containers; and (b) securing means for securing said axle in a selected position within said slots.

9. The container crusher apparatus in accordance with claim 7, wherein:

(a) said pulleys are sized such that said drum operably rotates in the range of 500–700 RPM.

10. The container crusher apparatus in accordance with claim 1, wherein:

(a) each of the containers is crushed by a single pass of said crusher arm.

11. A container crusher apparatus for crushing container such as aluminum beverage cans, plastic bottles and the like, said crusher apparatus comprising:

(a) a longitudinally-extending cylindrical outer housing with a circular bottom plate enclosure and a circular top tray enclosure;

(b) a rectangular inner housing within said outer housing, said inner housing having at least one side wall and being attached to said bottom plate and said top tray;

(c) said top tray including a feed opening sized and positioned to permit the containers to be introduced into said inner housing, said bottom plate including an outlet opening sized and positioned to permit crushed containers to exit said inner housing;

(d) a rotatable cylindrical drum positioned within said inner housing, the rotation axis of said drum being perpendicular to the longitudinal axis of said outer housing; said drum having a periphery and having at least one crusher arm attached to said periphery; said drum positioned for crushing the containers introduced into said inner housing against said side wall of said inner housing when said drum is rotated;

(e) wherein said crusher arm comprises an angle from section with a first side of said angle iron attached to and abutting said periphery of said drum and a second side of said angle iron extending radially outward from said periphery of said drum;

(f) a tapered leading edge provided along said second side of said angle iron; and (g) wherein there are a plurality of said crusher arms equally spaced about said periphery of said drum, each of said crusher arms being oriented at an angle of approximately 30 degrees relative to the longitudinal axis of said drum.

12. A container crusher apparatus for crushing containers such as aluminum beverage cans, plastic bottles and the like, said crusher apparatus comprising:

(a) a longitudinally-extending cylindrical outer housing with a circular bottom plate enclosure and a circular top tray enclosure;

(b) a rectangular inner housing within said outer housing, said inner housing having at least one side wall and being attached to said bottom plate and said top tray;

(c) said top tray including a feed opening sized and positioned to permit the containers to be introduced into said inner housing, said bottom plate including an outlet opening sized and positioned to permit crushed containers to exit said inner housing;

(d) a rotatable cylindrical drum positioned within said inner housing, the rotation axis of said drum being perpendicular to the longitudinal axis said outer housing; said drum having a periphery and having at least one crusher arm attached to said periphery; said drum positioned for crushing the containers introduced into said inner housing against said side wall of said inner housing when said drum is rotated;

(e) a safety cover placed over said feed opening in said top tray, said safety cover including an inlet opening adapted to receive the containers fed in a horizontal direction through which the containers are introduced into said safety cover, said inlet opening being positioned a sufficient distance from said feed opening to prevent an operator from reaching a hand into said feed opening; and (f) wherein said safety cover includes a hinged access panel over said feed opening, said hinged access panel including securing means, said securing means including a safety switch that opens a circuit such that power is cut off from said crusher apparatus upon the opening of said hinged access panel.

13. The container crusher apparatus in accordance with claim 12, wherein:

(a) said securing means include a threaded screw eye affixed to said hinged access panel which mates with a threaded bore in said safety cover, said screw eye requiring at least a first predetermined number of turns to completely secure said hinged cover to said safety cover, said safety switch closing said circuit to supply power to said crusher apparatus only after said screw eye has been threaded into said threaded bore a second predetermined number of turns, said second number being greater than said first number.

14. The container crusher apparatus in accordance with claim 12, including:

(a) a control switch mounted on the outside of said outer housing to control power to said crusher apparatus, said safety switch being wired in series with said control switch.

15. A container crusher apparatus for crushing containers such as aluminum beverage cans, plastic bottles and the like, said crusher apparatus comprising:

(a) a longitudinally-extending cylindrical outer housing with a circular bottom plate enclosure and a circular top tray enclosure;

(b) a rectangular inner housing with said outer housing, said inner housing having at least one side wall and being attached to said bottom plate and said top tray;

(c) said top tray including a feed opening sized and positioned to permit the containers to be introduced into said inner housing, said bottom plate including an outlet opening sized and positioned to permit crushed containers to exit said inner housing;

(d) a rotatable cylindrical drum positioned within said inner housing, the rotation axis of said drum being perpendicular to the longitudinal axis of said outer housing; said drum having a periphery and having at least one crusher arm attached to said periphery; said drum positioned for crushing the containers introduced into said inner housing against said side wall of said inner housing when said drum is rotated;

(a) a safety cover placed over said feed opening in said top tray, said safety cover including an inlet opening adapted to receive the containers fed in a horizontal direction through which the containers are introduced into said safety cover, said inlet opening being positioned a sufficient distance from said feed opening to prevent an operator from reaching a hand into said feed opening; and (f) a solenoid-operated safety door positioned within said inlet opening in said safety cover, said solenoid being adapted to open said safety door when power is switched on to said crusher apparatus and to close said safety door when said crusher apparatus power is switched off.

16. A container crusher apparatus for crushing containers such as aluminum beverage cans, plastic bottles and the like, said crusher apparatus comprising:

(a) a longitudinally-extending cylindrical outer housing with a circular bottom plate enclosure and a circular top tray enclosure;

(b) a rectangular inner housing with said outer housing, said inner housing having at least one side wall and being attached to said bottom plate and said top tray;

(c) said top tray including a feed opening sized and positioned to permit the containers to be introduced into said inner housing, said bottom plate including an outlet opening sized and positioned to permit crushed containers to exit said inner housing;

(d) a rotatable cylindrical drum positioned within said inner housing, the rotation axis of said drum being perpendicular to the longitudinal axis of said outer housing; said drum having a periphery and having at least one crusher arm attached to said periphery; said drum positioned for crushing the containers introduced into said inner housing against said side wall of said inner housing when said drum is rotated;

(e) a safety cover placed over said feed opening in said top tray, said safety cover including an inlet opening adapted to receive the containers fed in a horizontal direction through which the containers are introduced into said safety cover, said inlet opening being positioned a sufficient distance from said feed opening to prevent an operator from reaching a hand into said feed opening; and (f) wherein a plurality of stiff bristles are positioned within said inlet opening in said safety cover, said bristles being adapted to provide a mechanical resistance to containers being placed into said inlet opening.

* * * * *